US005360495A

United States Patent [19]

Schuler et al.

[11] Patent Number: 5,360,495

[45] Date of Patent: Nov. 1, 1994

[54] PROCESS FOR HARDENING CUTTING EDGES WITH AN OVAL SHAPED PLASMA BEAM

[76] Inventors: Albert Schuler, Costenoblegasse 2/4/5, A-1130 Vienna, Austria; Wladimir Tokmakov, Gidrostroitelei No. 4, Irkutsk, Russian Federation

[21] Appl. No.: 138,768

[22] Filed: Oct. 19, 1993

Related U.S. Application Data

[63] Continuation-in-part of Ser. No. 809,540, Jan. 24, 1992, abandoned.

[30] Foreign Application Priority Data

Jul. 25, 1989 [AT] Austria ..... A1796/89
Oct. 24, 1989 [AT] Austria ..... A2451/89

[51] Int. Cl.[5] ..... C21D 9/18

[52] U.S. Cl. ..... 148/565; 148/588; 148/714; 148/903; 219/121.37; 219/121.39; 219/121.59

[58] Field of Search ..... 148/565, 588, 714, 903; 219/121.36, 121.59, 121.37, 121.39

[56] References Cited

U.S. PATENT DOCUMENTS 3,615,924 10/1971 Swoboda et al. ..... 148/565
3,834,947 9/1974 Swoboda et al. ..... 148/565

FOREIGN PATENT DOCUMENTS 1233454 10/1960 France .
2623731 1/1977 Germany .
53-76121 7/1978 Japan ..... 148/565
2172821 11/1985 United Kingdom .
1643621 4/1991 U.S.S.R. ..... 148/565

OTHER PUBLICATIONS

WO 83/00051 Jan. 6, 1983.
Advances in Welding Processes; vol. 1, 1978 (Proc. Conf. 9–11 May 1978), pp. 181–184 D. Goodwin et al "Surface heat treatment . . . ".

*Primary Examiner*—Richard O. Dean
*Assistant Examiner*—Sikyin Ip
*Attorney, Agent, or Firm*—Collard & Roe

[57] ABSTRACT

An apparatus and process for hardening cutting edges having various widths. The apparatus includes a plasma torch for projecting a plasma beam through an outlet nozzle. The outlet nozzle has a length parallel to the cutting edge and a width perpendicular to the cutting edge. The nozzle width is greater than the nozzle length. A variable electromagnet is located adjacent the nozzle for adjustably deflecting the plasma beam from a circular cross section beam to a widened beam. The electromagnet deflects the plasma beam at its width so that it is slightly wider than the width of the cutting edge to be hardened. The plasma beams with a smaller cross section have a lower power consumption and a constant gas flow rate than larger cross sectional beams.

9 Claims, 5 Drawing Sheets

PROCESS FOR HARDENING CUTTING EDGES WITH AN OVAL SHAPED PLASMA BEAM

This application is a continuation-in-part application of Ser. No. 07/809,540, filed Jan. 24, 1992, now abandoned.

BACKGROUND OF THE INVENTION

1. Field of the Invention

The invention relates to an apparatus and a process for hardening the cutting edges of saws, especially for working wood, as well as knives, cutting tools and punching tools for working wood, paper, paperboard, plastic, leather or textiles, by an energy beam which is passed over the cutting edge of the tool to be hardened. Saws, knives or cutting tools and punching tools experience wear at the cutting edges. The useful life of these tools depends on the quality of the cutting edge, on the material cut and on the cutting output. At the end of their useful life, these tools are either reground or scrapped. Many types of saws, knives, cutting tools and punching tools are made of carbon steel, which can easily be hardened by heating and subsequent rapid cooling. But since such hardening always results in a reduction in strength, great hardness is desired only in the area of the cutting edges. The other parts of a saw, a knife or a cutting tool should have lesser hardness, but greater strength.

2. Description of the Related Art

Known methods for partially hardening cutting edges use electron or laser beams as the energy source. A disadvantage exists with the known electron beams or laser beams in that they are complicated devices. For this reason, such processes are hardly used in practice.

Another known hardening process is inductive hardening. After grinding the cutting edge, the cutting edge area is heated by an eddy current, generated by a high-frequency magnetic alternating field, and hardened by rapid cooling.

Furthermore, it is known from WO 83/00051 to carry out surface hardening of flat areas by means of a plasma beam. Hardening cutting edges by plasma beams was not considered until recently, however, because plasma beams are unstable.

In saws, welding stellite onto the tooth tips is known. The stellite material welded on is subsequently ground to the desired pointed tooth shape. However, this process is very complicated. It is an object of the present invention to provide a process for hardening the cutting edges of saws, knives, cutting tools and punching tools in which an energy beam which is simple to produce and cost-effective to operate is used.

SUMMARY OF THE INVENTION

According to the invention, a plasma beam is used as the energy source and is guided at a relative velocity of 5 to 100 mm/sec with reference to the tool. The distance of the outlet nozzle of the plasma torch from the cutting edge is between 2 and 14 mm, the power of the plasma beam is between 1 and 10 kW, and the diameter of the outlet nozzle of the plasma torch is between 3 and 7 mm.

Surprisingly, it was found that with a precisely coordinated set of parameters, it is possible to use a plasma beam for hardening cutting edges without additional cooling, for example by air or water.

The heating and cooling speed is adapted to optimum values at different material thicknesses and cutting edge angles with the forward velocity v. For thinner blade thickness, especially below 3 mm, i.e. for smaller cutting edge angles, especially below 25°, the forward velocity must be selected higher, since otherwise the cooling rate is too small for sufficiently high hardening, due to the limited heat conduction into the base material. For greater blade thicknesses, i.e. cutting edge angles, the forward velocity can be selected lower to achieve larger hardening zones.

Plasma beams are produced by ionization of argon or nitrogen, or of mixed gases. Ionization takes place by electric arc discharge or by excitation with a high-frequency electromagnetic field. A suitable configuration of the electrodes or the nozzles results in a beam having temperatures up to 15,000° C. along the axis.

If such a plasma beam is passed over the ground cutting edge of a saw, a knife or a cutting tool at the parameters according to the invention, a local area of the cutting edge heats up, at heating rates of up to 5000K/sec. After termination of the energy feed, the cutting edge cools by self-quenching, i.e. by heat conduction into the base material of the tool, at cooling speeds of up to 1000K/sec. This results in a fine-grain martensite structure with hardnesses up to 1000 HV (Vickers hardness).

However, it is critical in such processes that the cutting edge does not melt during the heat treatment. Nevertheless, sufficient heating must be present in the area of the cutting edge in order to ensure the desired hardening. This is only achieved with the parameters indicated above.

Particularly good results for hardening occur at the following values:

| | |
|---|---|
| Power of the plasma beam: | 1 to 5 kW |
| Diameter of the beam at the outlet nozzle of the plasma torch: | 4 to 5.5 mm |
| Distance at the outlet nozzle of the plasma torch from the cutting edge: | 3 to 9 mm |
| Relative velocity of the plasma beam with reference to the cutting edge: | 15 to 50 mm/sec |

Preferably, a knife or cutting tool is guided through the plasma beam by mechanical movement along the cutting edge, where the axis of the plasma beam coincides with the axis of symmetry of the cutting edge. In this manner, the most uniform possible heat effect is achieved over the flanks of the cutting edge. In the case of saws, the plasma beam is guided over the back of the teeth, in the area of the upper cutting edge, by mechanical movement of the plasma torch perpendicular to the saw blade. In this manner, the most uniform possible heat effect is achieved over the entire length of the cutting edge of the tooth tip. For certain saw shapes, it is advantageous and simpler technically to guide the plasma torch along the saw blade without perpendicular movement. Electromagnetic deflection by a coil, which is arranged in the area between the cathode and the bottom edge of the nozzle, broadens the plasma beam for adaptation to the tooth geometry (e.g. for cross saws). The difference from the known method of electromagnetic deflection of the plasma beam for melt treatment (hardfacing) is that in the prior art the effect of the electromagnetic field takes place in the area between the bottom edge of the nozzle and the workpiece surface. This requires the cathode to be located on the workpiece surface. This known method does not work in plasma hardening since the arc must extend between the cathode and the bottom edge of the nozzle.

A reduction in the energy requirement in hardening can be achieved with a pulsating plasma beam, at a pulse frequency f, with f=forward velocity of the saw blade divided by the distance between teeth, where the pulse duration lies in the range from 0.2 to 0.8 sec.

For knives, it is furthermore possible that the axis of the plasma beam covers a certain angle (e.g. 90°, 135° or half of the cutting edge angle) relative to the axis of symmetry of the cutting edge. In this way, a distribution of the hardening zone which is asymmetrical to the axis of symmetry, and thus an adaptation to special wear situations, can be achieved. For knife blades with a thickness of more than 5 mm, in particular, good adaptation of the hardening zone to various cutting edge geometries is thereby possible.

BRIEF DESCRIPTION OF THE DRAWING

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

DESCRIPTION OF THE PREFERRED EMBODIMENTS

Figure 1:
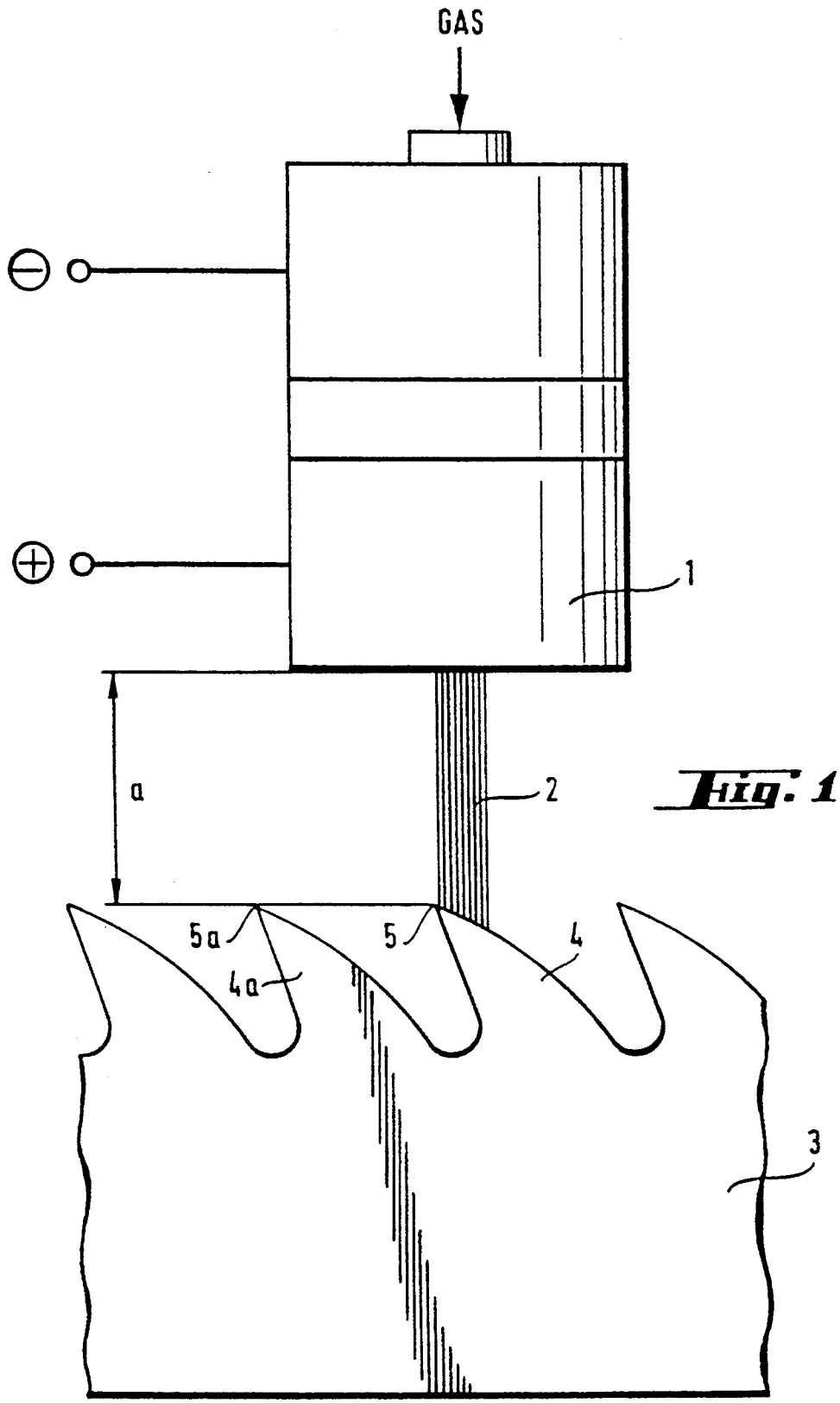
FIG. 1 is a schematic of the plasma system for saw hardening.

Referring to FIG. 1, plasma torch 1 generates a plasma beam 2 from the gas fed to it, using an electric arc discharge. Plasma beam 2 exits at the outlet nozzle of the plasma torch 1. The distance between the outlet nozzle and the cutting edge is a. Plasma beam 2 is directed at a top 5 of a saw tooth 4 and heats this area. After termination of plasma beam 2, the heated area cools rapidly and hardens. Subsequently, the saw blade 3 is moved forward and the plasma beam 2 is directed at a top 5*a* of the following tooth 4*a*.

Figure 2:
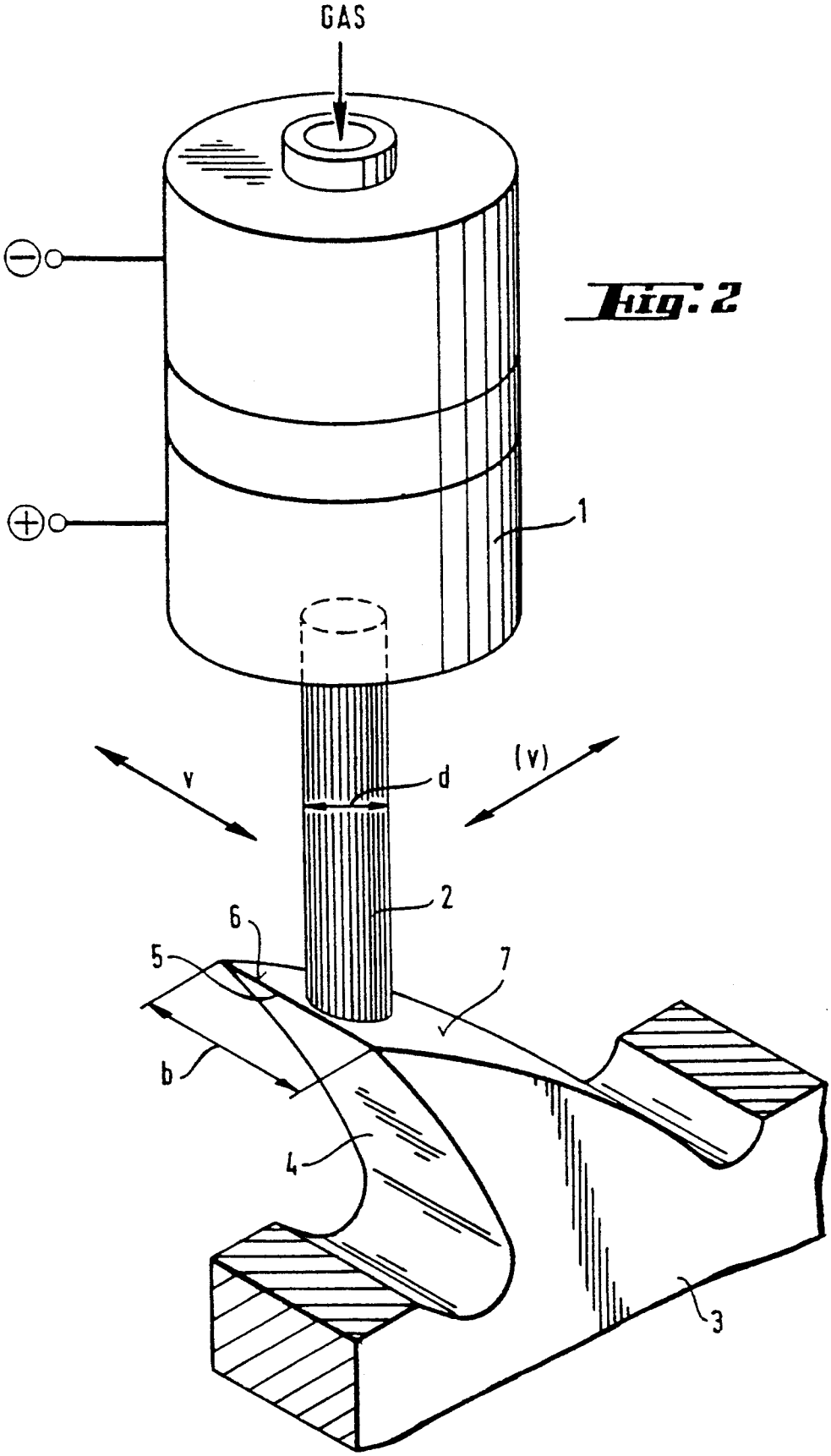
FIG. 2 is an enlarged perspective view of the area of the tooth top of a saw blade.

As shown in FIG. 2, plasma beam 2 has a diameter d and is moved either along the cutting edge 6 or in the same direction that the teeth face at a relative velocity v.

Figure 3:
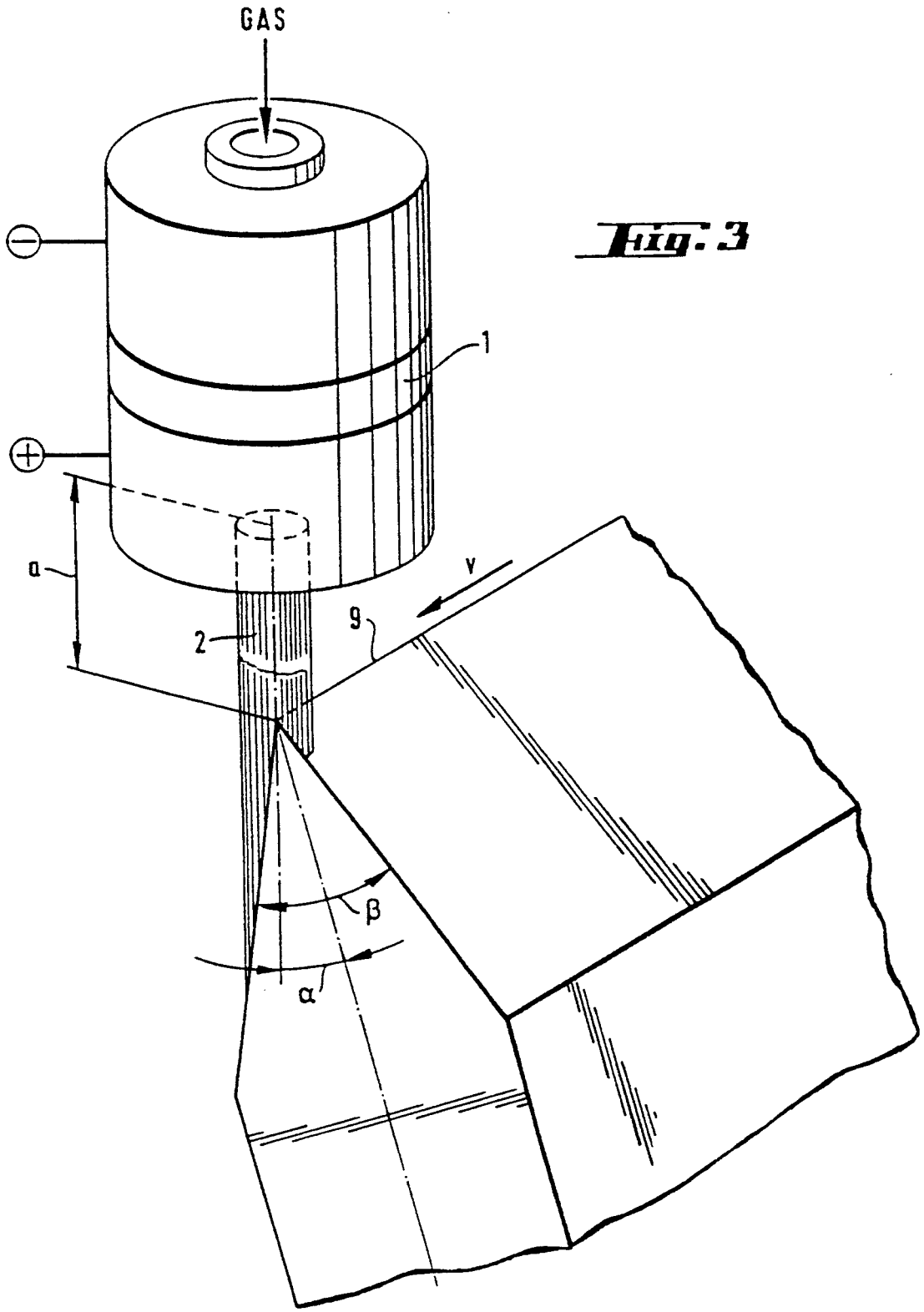
FIG. 3 is a schematic of the plasma system used for hardening the cutting edge of a knife.

In the embodiment of FIG. 3, the plasma beam is directed at the cutting edge 9 of a knife at an angle $\alpha$, and is moved along this edge at the velocity v, where this edge is heated. After termination of the energy effect, the heated area cools rapidly by self-quenching and hardens.

Figure 4:
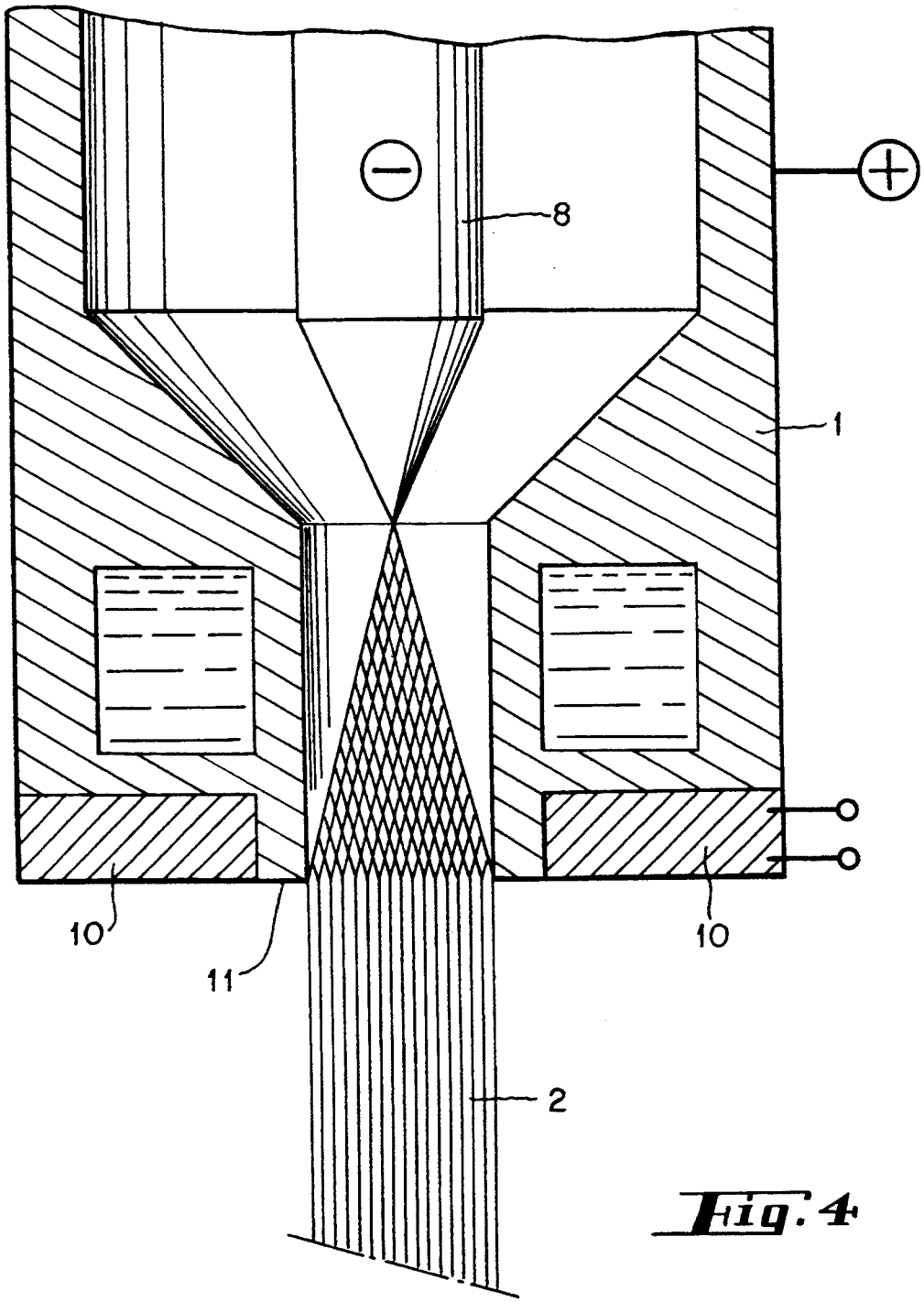
FIG. 4 is a in cross-sectional view of the outlet nozzle of a plasma torch.

FIG. 4 shows an electromagnet 10, arranged in the area between cathode 8 and bottom edge 11 of the nozzle of plasma torch 1, which causes widening of plasma beam 2 by high-frequency deflection of the arc within the nozzle area.

Figure 5:
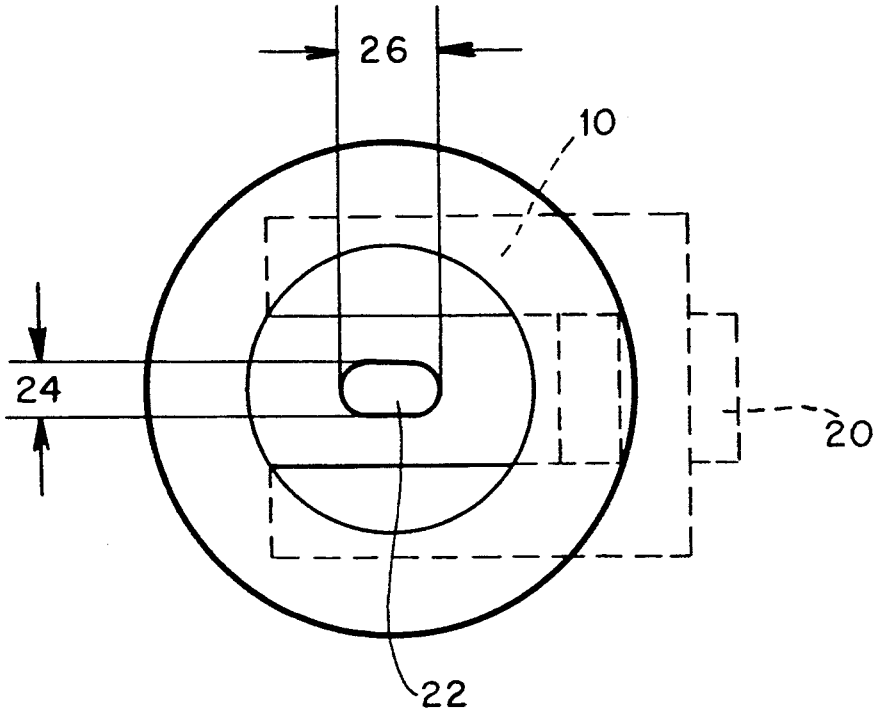
FIG. 5 is a cross-sectional view of an oval nozzle surrounded by a control magnet.

FIG. 5 shows a U-shaped electromagnet 10 with a control coil 20 wrapped around the base of electromagnet 10. The legs of electromagnet 10 are located on either side of nozzle 22. The legs of electromagnet 10 are arranged parallel to the major axis of the oval which has a width 26, for example 4.5 mm long. The minor axis of oval 22 has a width 24, for example 2.5 mm. Optional nozzle 22 can be rectangular with a length 26 and a width 24. The key feature of nozzle 22 is that the two longer edges are parallel to each other and to the legs of electromagnet 10.

The plasma beam is initially generated with a circular cross section having a diameter equal to width 24. The beam is centered within nozzle 22. The diameter of the initial beam is 2.5 mm and has an area of approximately 5 $mm^2$, for example. If a wider beam is required, i.e. the surface to be treated is wider than 2.5 mm, control coil 20 can be used to elongate the beam so that it completely fills nozzle 22. Such a beam would have a length of 4.5 mm, a width of 2.5 mm, and a cross sectional area of 9.9 $mm^2$. The current through control coil 20 can be continuously adjusted to specifically adjust the configuration of the beam between the minimum circular beam and the maximum oval beam. This configuration is adequate for treating surfaces, for example saw blades, having a width in a range of 2 to 4 mm.

If a surface to be treated has a width greater than 4 mm, a nozzle having a length of up to 6 mm, for example, may be used. Such a nozzle would have a width of 2.5 mm or slightly wider.

The plasma jet has a discharge temperature of 15,000° C. which hits the surface of a saw tooth, for example. The core of the saw tooth remains cold. The heat flows quickly from the surface of the saw tooth into the cold interior after the plasma jet has passed, whereby the structure solidifies. This process of plasma hardening does not require a cooling bath, as the structure to be hardened undergoes self-quenching.

In order to maintain a discharge temperature of 15,000° C., the rate of argon consumption is 3 liters per minute. The current supply to electromagnet 10 is between 120 and 160 amperes (A), depending on the saw width, at 14 volts (V) DC. The nozzle has an oval cross section with a 2.5 mm minor axis and a 4.5 mm major axis. This size nozzle can be used for saws having widths of between 2 to 4 mm. The nozzle has a 9.9 $mm^2$cross section with the major axis of the oval oriented perpendicular to the surface to be treated. The nozzle exit edge is located 4.5 mm to the closest point of the surface to be treated. Each saw tooth is treated for 0.1 second. The cross section of the plasma jet is adjustable from a circle having a diameter of 2.5 mm to an oval having the dimensions of the nozzle, i.e. 2.5 mm$\times$4.5 mm. The cross section of the plasma jet is controlled by electromagnet 10. The control current through coil 20 is used to continuously adjust the width of the plasma jet. When the control current is off, the plasma jet has a circular cross section. As the control current through coil 20 increases, the plasma jet changes to an oval cross section.

The argon consumption of 3 liters per minute through the oval nozzle having a cross section of 9.9 $mm^2$ results in a specific flow speed. This flow speed is selected to sufficiently cool the tungsten cathode and the copper nozzle so that they do not burn up or evaporate during the hardening process. As a comparison, a larger round nozzle having a diameter of 4.5 mm, for hardening a saw having a widths of 4.5 mm. has a nozzle cross section of 15.9 $mm^2$. If the argon flow of 3 liters per minute was used with the nozzle having a cross section of 15.9

$mm^2$, the flow speed would decrease. The slower moving argon would not be able to adequately cool the cathode and the nozzle at this reduced flow speed. As a result, the cathode would burn up and the nozzle would evaporate at its surface. To achieve the same cooling effect with the 15.9 $mm^2$nozzle, the argon consumption rate would have to be increased to approximately 5.5 liters per minute. In order to heat the increased argon plasma volume to the required 15,000° C. core temperature, the current would have to be increased to 200 amperes at 14 volts DC. As can be seen, the oval nozzle is clearly more energy-efficient than the larger round nozzle. The energy required with the apparatus and process according to the invention is dependent on the cross-sectional area of the beam.

Hardening of thinner saws is particularly uneconomical as the plasma jet primarily heats the air to the left and right of the saw. Typically, the nozzle has to be changed when the widths of the surface to be hardened changes. Changing the nozzle is a cumbersome task which results in down time of the equipment. When various saw widths are to be hardened successively, the constant changing of the nozzle is impractical. The most practical and economical way to harden surfaces of varying widths is to utilize an oval nozzle where the plasma jet can be simply adjusted by the current through control coil 20.

The following embodiments are intended to explain the use of the process in more detail:

Example 1: Hardening of a reciprocating saw

Material: Band steel B412 (alloy steel with 0.85% C, 0.3%, Si, 0.3% Mn, 0.5% Cr, 0.4% Ni, 0.25% V), 45 teeth, distance between teeth 30 mm Width b of the cutting edge: 3.5 mm Hardness in the untreated state 420 HV (Vickers)

| | | | |
|---|---|---|---|
| Plasma power (kW) | 2.5 | 3.5 | 2.0 |
| Beam diameter (d in mm) | 4.0 | 4.0 | 4.0 |
| Distance (a in mm) | 5.0 | 6.0 | 4.0 |
| Forward velocity (v in mm/sec) | 25 | 30 | 20 |
| Gas through-flow (l/min) | 7 | 10 | 7 |
| Maximum hardness (HV) | 920 | 940 | 900 |

Practical cutting tests in saw mills resulted in an increase in useful life by a factor of 5.

Example 2: Hardening of a circular saw

Material: Saw steel B412, 50 teeth, distance between teeth 30 mm

Width be of the cutting edge: 4.0 mm

Hardness in the untreated state 410 HV (Vickers)

| | |
|---|---|
| Plasma power (kW) | 3.0 |
| Beam diameter (d in mm) | 4.0 |
| Distance (a in mm) | 5.0 |
| Forward velocity (v in mm/sec) | 30 |
| Gas through-flow (l/min) | 8 |
| Maximum hardness (HV) | 900 |

Example 3: Hardening of a band saw

Material: Saw steel B412, band length 6 m, distance between teeth 15 mm

Width b of the cutting edge: 1.5 mm

Hardness in the untreated state 410 HV.

| | |
|---|---|
| Plasma power (KW) | 1.5 |
| Beam diameter (d in mm) | 3.0 |
| Distance (a in mm) | 5.0 |
| Forward velocity (v in mm/sec) | 20 |
| Gas through-flow (l/min) | 7 |
| Maximum hardness (HV) | 900 |

Example 4: Hardening of a punch knife for leather and textiles

Material: Band steel CK60 (material No. 1.1221)

Thickness: 2 mm

Hardness in the untreated state: 300 HV (Vickers)

| | | | |
|---|---|---|---|
| Plasma power (KW) | 1 | 2 | 4 |
| Beam diameter (d in mm) | 4 | 4 | 4 |
| Distance (a in mm) | 4 | 6 | 8 |
| Angle between plasma axis and axis of cutting edge (degrees) | 0 | 0 | 0 |
| Forward velocity (v in mm/sec) | 25 | 35 | 50 |
| Gas through-flow (l/min) | 5 | 5 | 5 |
| Maximum hardness (HV) | 860 | 890 | 940 |

Example 5: Hardening of a planing knife for woodworking

Material: 80 CrV 2 (material No. 1.2235)

Thickness: 8 mm

Hardness in the untreated state: 280 HV (Vickers)

| | | | |
|---|---|---|---|
| Plasma power (kW) | 2 | 3 | 5 |
| Beam diameter (d in mm) | 4 | 4 | 4 |
| Distance (a in mm) | 4 | 6 | 8 |
| Angle between plasma axis and axis of cutting edge (degrees) | 60 | 90 | 120 |
| Forward velocity (v in mm/sec) | 20 | 30 | 40 |
| Gas through-flow (l/min) | 5 | 5 | 6 |
| Maximum hardness (HV) | 840 | 880 | 905 |

Example 6: Comparative test with 4 mm and 2 mm wide saws with oval and round nozzle All tests IA, IB, IIA and IIB achieved perfect hardening to 68 HRC in 0.1 seconds per tooth. Cathode life was rated at more than 1000 ignitions. There was no noticeable wear and tear on the nozzles.

I. Oval nozzle according to the invention (4.5 mm×2.5 mm, 9.9 $mm^2$ cross-sectional area)

Argon consumption: 3 liters per minute

A. 4 mm wide saws

| | |
|---|---|
| Plasma power | 160 A at 14 V DC |
| Control magnet power (4.5 mm) | 50 Hz at 80 V |
| Total power consumption | 2,240 Watts |

B. 2 mm wide saws

| | |
|---|---|
| Plasma power | 120 A at 14 V DC |
| Control magnet power (2.5 mm) | 0 V |
| Total power consumption | 1,680 Watts |

II. Round nozzle according to the prior art (4.5 mm diameter, 15.9 $mm^2$ cross-sectional area)

Argon consumption: 5.5 liters per minute

A. 4 mm wide saw

| | |
|---|---|
| Plasma power | 200 A at 14 V DC |
| Control Magnet Power | (no control magnet) |
| Total power consumption | 2,800 Watts |

B. 2 mm wide saw

| | |
|---|---|
| Plasma Power | 200 A at 14 V DC |
| Control Magnet Power | (no control magnet) |
| Total power consumption | 2,800 Watts |

The round nozzle requires more energy to harden the 4 mm wide saw to the same extent as the oval nozzle. In addition, the round nozzle does not provide any energy savings when hardening a 2 mm wide saw compared to a 4 mm wide saw. The oval nozzle provides a 25% energy savings when hardening the 2 mm wide saw.

What is claimed is:

1. A process for hardening cutting edges having varying widths, each cutting edge consisting of a sequence of teeth on a saw blade, the saw teeth having tips pointing in one direction and a width perpendicular to said direction, which comprises the steps of:

(a) projecting a plasma beam having a power of 1 to 10 kW through an outlet nozzle of a plasma torch, the plasma torch comprising (1) a cathode having a tip pointing to the outlet nozzle and (2) the outlet nozzle having a bottom edge facing the cutting edge and a nozzle length parallel to said direction and a nozzle width perpendicular to said direction, said nozzle width being greater than said nozzle length;

(b) altering the configuration of the plasma beam by electromagnetic deflection, at a frequency between 10 and 200 Hertz perpendicularly to said direction, between the cathode tip and the bottom edge of the outlet nozzle to produce a widened beam having an oval shape that is slightly wider than the width of the cutting edge to be hardened, wherein the widened plasma beams have a lower power consumption at a constant gas flow rate than circular plasma beams having a diameter equal to a major axis of the widened plasma beams;

(c) positioning the cutting edge at a distance of 2 to 14 mm from the bottom edge of the outlet nozzle in the path of the plasma beam; and d) guiding the plasma beam at a relative velocity of 5 to 100 mm/sec relative to the cutting edge, the cutting edge of the saw blade being guided by movement of the cutting edge in said direction.

2. The process of claim 1, wherein the plasma beam is permanently moved by pulsation, each pulse having a duration of 0.2 to 0.8 seconds and the pulse frequency being equal to the velocity of the cutting edge movement divided by the distance between the teeth.

3. The process of claim 1, wherein the cutting edge of the saw blade is guided in said direction in a step-by-step movement.

4. The process of claim 1, wherein the cutting edge of the saw blade is guided in said direction in continuous movement.

5. The process of claim 1, wherein the cutting edge is positioned at a distance of 3 to 14 mm from the bottom edge of the outlet nozzle in the path of the plasma beam.

6. The process of claim 5, wherein the plasma beam is guided at a relative velocity of 15 to 50 mm/sec relative to the cutting edge.

7. The process of claim 6, wherein the plasma beam has a power of 1 to 5 kW.

8. The process of claim 7, wherein said outlet nozzle has a width of 3 to 7 mm.

9. The process of claim 8, wherein said outlet nozzle has a width of 4 to 5.5 mm and a length of approximately 2.5 mm.

* * * * *